US005502454A

United States Patent [19]

Psinakis et al.

[11] Patent Number: 5,502,454

[45] Date of Patent: Mar. 26, 1996

[54] ELECTRICAL CONDUCTING SHEEL STRUCTURE FOR COAXIAL COLLINEAR ARRAY ANTENNA

[75] Inventors: Thomas J. Psinakis, East Meadow; John E. Arthur, III, Island Park; Anthony M. Bucceri, Larchmont, all of N.Y.

[73] Assignee: Unisys Corporation, Blue Bell, Pa.

[21] Appl. No.: 337,334

[22] Filed: Nov. 9, 1994

[51] Int. Cl.[6] ..... H01Q 9/04

[52] U.S. Cl. ..... 343/791; 343/790; 174/70 A

[58] Field of Search ..... 343/790, 791, 343/792, 905, 906; 174/40 R, 41, 70 A, 75 C, 88 C, 99 R, 138 A

[56] References Cited

U.S. PATENT DOCUMENTS

| | | | |
|---|---|---|---|
| 2,115,761 | 5/1938 | Blumlein | 343/790 |
| 4,378,462 | 3/1983 | Arnold, Jr. et al. | 174/70 A |
| 4,400,702 | 8/1983 | Tanaka | 343/790 |
| 4,983,987 | 1/1991 | Woloszczuk | 343/905 |
| 5,095,176 | 3/1992 | Harbrecht et al. | 174/41 |
| 5,285,211 | 2/1994 | Herper et al. | 343/791 |

*Primary Examiner*—Donald T. Hajec
*Assistant Examiner*—Tan Ho
*Attorney, Agent, or Firm*—Seymour Levine; Mark T. Starr

[57] ABSTRACT

A shell structure for a collinear coaxial element array antenna is made of electrical conducting material and includes first and second circular sections separated by a web. The first circular section has an inner diameter that is slightly larger than the diameter of an inner conductor in a coaxial line element of the array antenna, while the second circular section has an inner diameter that is equal to that of an outer conductor of a coaxial transmission line element. The separations of the centers of the first and second circular sections are established by the wed to be equal to the distance between the centers of two adjacent coaxial transmission line elements in the array antenna. The inner conductor of a coaxial transmission line element is inserted in the first circular section and is electrically connected thereto. This electrically connects the inner conductor of one coaxial transmission line element to the second circular section, which serves as the outer conductor of a coaxial transmission line element that is adjacent to the one coaxial transmission line element, thereby electrically connecting the inner conductor of the one coaxial transmission line element to the outer conductor of its adjacent coaxial transmission line element.

6 Claims, 2 Drawing Sheets

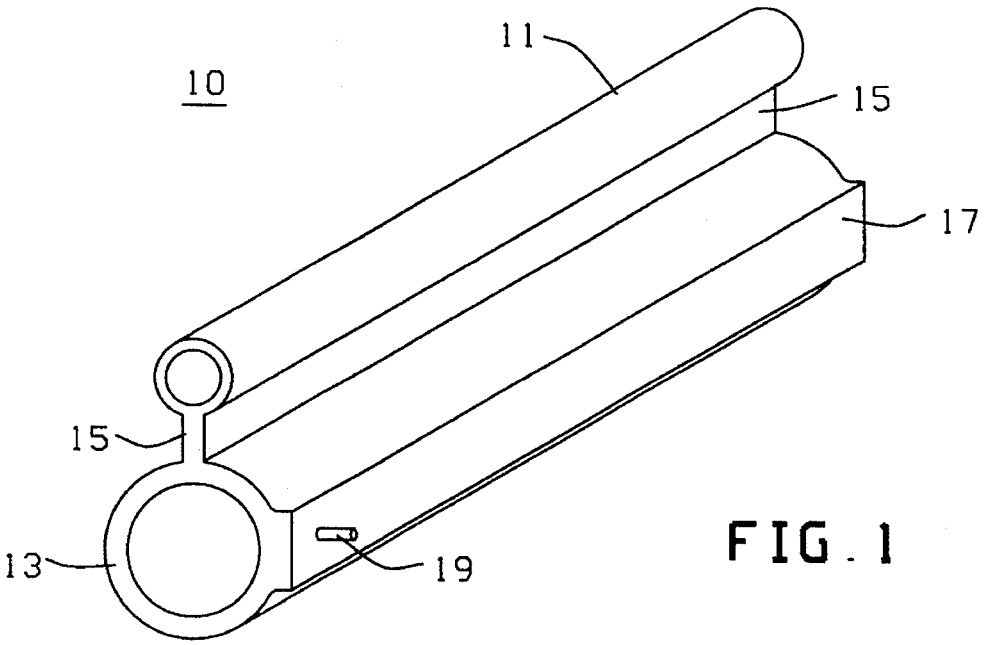
FIG. 1
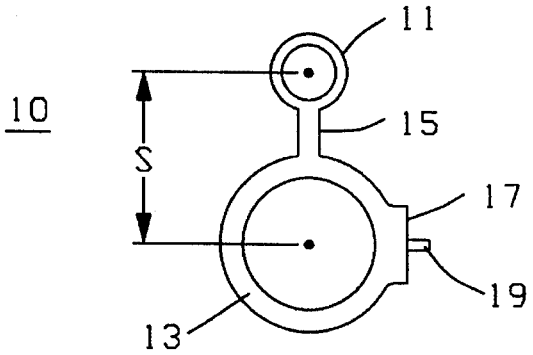
FIG. 2A
FIG. 2B
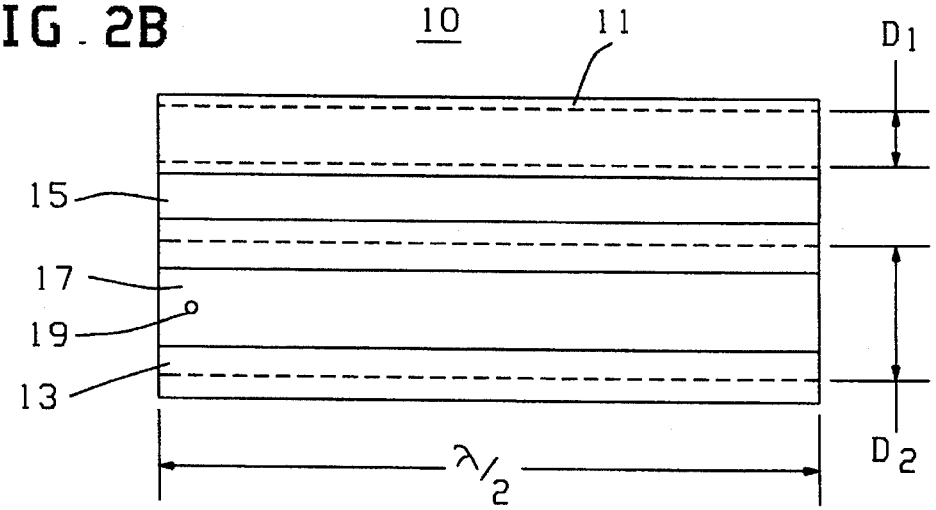

ELECTRICAL CONDUCTING SHEEL STRUCTURE FOR COAXIAL COLLINEAR ARRAY ANTENNA

BACKGROUND OF THE INVENTION

1. Field of the Invention

The invention pertains to the field array antennas and more particularly to an array of coaxial elements arranged in a linear alignment.

2. Description of the Prior Art

A linear array of coaxial elements of the prior art comprises a plurality of coaxial cables, each having a solid dielectric between the inner and outer conductors, wherein the inner conductor of one cable is connected to the outer conductor of the succeeding cable. The wavelength of a wave propagating within a cable section is a function of the dielectric constant of the dielectric material and is given by $\lambda/\sqrt{\epsilon}$, where $\lambda$ is the free space wavelength and $\epsilon$ is the dielectric constant of dielectric material. Each section is one half a cable wavelength long. Since the dielectric on the outside of the cable is air, which has a dielectric constant that is less than that of the solid dielectric, the wavelength of a propagating wave in free space exceeds the cable wavelength. Consequently, each section is less than one half of a free space wavelength, the overall length being $\lambda/2\sqrt{\epsilon}$. Performance of the prior art coaxial collinear array is degraded by the dielectric loading in three ways: first, the current distribution over the element sections is not uniform; second, the dielectric is lossy and contributes to antenna inefficiency; and third, the length per section is foreshortened, thereby adversely effecting the antenna gain. Further, the element sections are constructed of semi-rigid coaxial cable which must be cut to close tolerances, stripped at the ends, and the delicate operation of soldering the inner conductor of one section to the outer conductor of the next section performed. The soldering operation is especially difficult when the dielectric material has a low melting temperature such as polyethylene foam which is commonly used for its low loss characteristics.

A coaxial collinear array having an air dielectric between the inner and outer conductors of the coaxial elements is disclosed in U.S. Pat. No. 5,285,211 issued on Feb. 8, 1994 to Herper, et al and assigned to the assignee of the present invention. This array utilizes a coupler positioned between each half-wavelength section which has supports for the outer conductor and through passages for the inner conductors of adjacent sections. The outer conductor supports and the inner conductor through passages maintain the positioning of the inner and outer conductors without additional dielectric support, thus providing coaxial line sections with air dielectric. This design, however, still requires soldering of the inner conductor of one coaxial section to the outer conductor of its adjacent coaxial section. Though many of the soldering problems of the dielectric supported elements are solved, it is possible to have a cold solder joint which may be weakened by vibrations or stresses in shipment.

SUMMARY OF THE INVENTION

In accordance with the principles of the present invention a coaxial collinear array antenna includes a shell structure having two circular sections of different diameters which are joined by a web. The larger diameter section, which is one half wavelength long, is positioned to from the outer conductor of a coaxial line element of the collinear array, while the smaller diameter section is a guide for the inner conductor of an adjacent coaxial element. A rod that forms the inner conductor of the adjacent coaxial element is passed through the smaller diameter section and connected thereto in a manner to establish excellent electrical contact, thereby creating a 180° phase reversal at the array element junction. This connection is preferably made by crimping, though soldering may be employed. The soldering drawbacks of the prior art are overcome by the containment of the solder between the rod and the inner surface of the smaller diameter section. Thus, since a 180° phase reversal occurs across each element, the 180° phase reversal that occurs at the junction of the adjacent elements causes corresponding regions on the radiating elements of the array, which are the outer conductors of the coaxial transmission lines, to be excited in phase. A flat area on the outer surface of the larger diameter section is provided to accommodate baluns through which energy may be coupled to the array.

BRIEF DESCRIPTION OF THE DRAWINGS

FIG. 1 is a pictorial presentation of the invention.

FIGS. 2A and 2B are side and front views of the invention, respectively.

DESCRIPTION OF THE PREFERRED EMBODIMENTS

Figure 3:
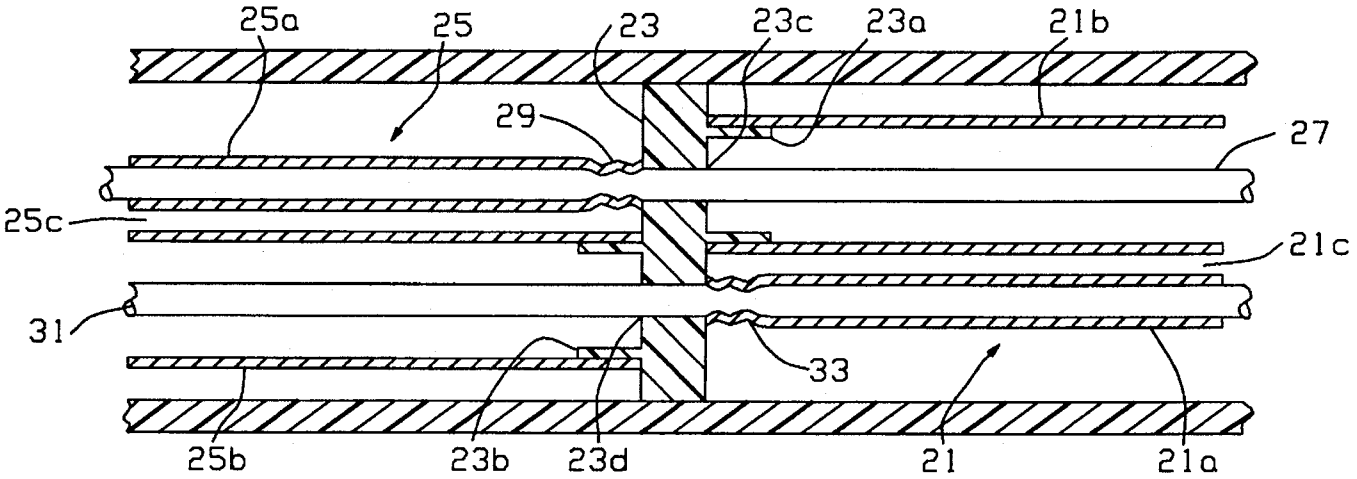
FIG. 3 is a cross-sectional view of a coupling region of a coaxial collinear antenna utilizing the invention.

Refer now to FIGS. 1, 2A, and 2B. A shell structure 10 for use in a coaxial collinear antenna is made entirely of an electrical conducting material. A first circular section 11 is joined to a second circular section 13 by a web 15, thereby providing an integral unit. The inner diameter of the first circular section $D_1$ is chosen for easy passage of a rod which serves as an inner conductor of a coaxial element in the coaxial collinear array. The diameter $D_1$ is slightly greater than the diameter of an inner conductor of a coaxial element in the array so that the first circular section 11 may be crimped to the inner conductor extending from an adjacent coaxial element in the coaxial collinear array antenna to establish a positive electrical connection. The second circular section has a length that is equal to one-half the wavelength $\lambda$ of a propagating wave in an air dielectric coaxial transmission line and an inner diameter $D_2$ that is equal to the inner diameter of an outer conductor of a coaxial element in the coaxial collinear array antenna. As will be described, the second section 13 is the outer conductor of one coaxial element in the array antenna and the first section 11 is a guide, support, and a means for electrically coupling the inner conductor of an adjacent coaxial element to the outer conductor of the one coaxial element. The length of the first circular section is shown as equal to the length of the second section. Though the length of the two sections need not be equal, the length equality is preferred.

A separation S between the centers of the first and second circular sections establishes an offset between adjacent coaxial elements in the collinear array. A flat area 17 on the second section may be provided to accommodate baluns or other circuitry for exciting the array antenna. This flat area may also include a terminal 19 for coupling the exciting circuitry to the array. A variety of terminal types may be employed, including a welded stud, hole for rivet or other fastener, solder connector, or other connection apparatus.

Refer now to FIG. 3, wherein a cross-sectional view of a coaxial collinear array antenna at a coupling region of two coaxial transmission line elements is shown. The second circular section of a first shell structure 21 is mounted an outer conductor support 23*a* on one side of a dielectric coupler 23, which my be the coupler disclosed in the aforementioned U.S. Pat. No. 5,285,211, and the second circular section of a second shell structure 25 is mounted on an outer conductor support 23*b* on the other side of the dielectric coupler 23. The outer conductor supports 23*a* and 23*b* are offset with a spacing therebetween which aligns the axes of the first 25*a* and second 25*b* circular sections of shell structure 25 with the axes of the second 21*b* and first 21*a* circular sections of shell structure 21, respectively.

A first rod 27 is coaxially positioned with the second circular section 21*b* of the first shell structure 21 to establish a coaxial transmission line array element with the rod 27 as the inner conductor and the second circular section 21*b* of the first shell structure 21 as the outer conductor. This rod 27 extends through a passage-way 23*c* in the coupler 23 into the first circular section 25*a* of the second shell structure 25. An electrical connection is made between the rod 27 and the first circular section 25*a* of the second shell structure 25. This electrical connection can be made by crimping the first circular section 25*a* to the rod 27 in a region 29, the preferred method, or by soldering the first circular section 25*a* to the rod 27.

Similarly, a second rod 31 is coaxially positioned with the second circular section 25*b* of the second shell structure 25 to establish a coaxial transmission line array element with the rod 31 as the inner conductor and the second circular section 25*b* of the second shell structure 25 as the outer conductor. This rod 31 extends through a passage-way 23*d* in the coupler 23 into the first circular section 21*a* of the first shell structure 21. An electrical connection is made between the rod 31 and the first circular section 21*a* of the second shell structure 21. This electrical connection, as previously discussed, can be made by crimping the first circular section 21*a* to the rod 31 in a region 33, the preferred method, or by soldering the first circular section 21*a* to the rod 31.

It should be recognized that the first and second circular sections of the shell structures 21 and 25 are electrically connected through webs 21*c* and 25*c*, respectively. Thus, the inner conductor of the coaxial transmission line formed by the rod 27 and the second circular section 21*b* of the shell structure 21 is electrically connected to the outer conductor of the coaxial transmission line formed by the rod 31 and the second circular section 25*b* of the shell structure 25. Similarly,the inner conductor of the coaxial transmission line formed by the rod 31 and the second circular section 25*b* of the shell structure 25 is electrically connected to the outer conductor of the coaxial transmission line formed by the rod 27 and the second circular section 21*b* of the shell structure 21. These electrical connections reverse the phase of a wave exciting the antenna across the coupling region. Thus, since the phase has been reversed across the coaxial transmission element, by virtue of the one-half wavelength length of the coaxial transmission element, each region of the two coaxial transmission line elements are, respectively, excited in phase.

Figure 4:
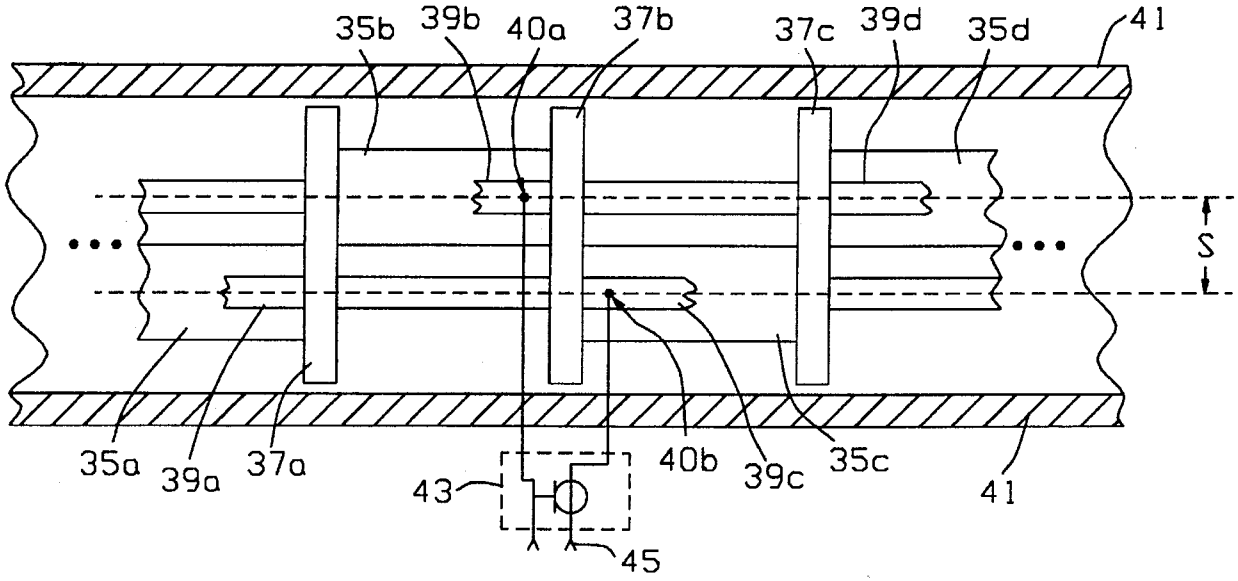
FIG. 4 is a schematic diagram of four elements of a coaxial collinear antenna utilizing the invention.

Refer now to FIG. 4 whereat a schematic diagram of four coaxial transmission elements in a coaxial collinear array antenna is shown. Coaxial transmission line elements 35*a*–35*d* formed by passing center conductors through the second circular sections of the shell structure, are supported by dielectric couplers 37*a*–37*c* and coupled to adjacent coaxial transmission line elements by extending the inner conductor of one coaxial transmission line element through a coupler into the first circular section of the adjacent shell structure, as described above. The shell structures of the coaxial transmission lines are oriented to have the flat sections 39*a*–39*c* uniformly positioned. The antenna is completed by inserting the assembled elements into a radome 41 and coupling posts 40*a* and 40*b*, on two selected flat sections, via a balun 43 to the array antenna terminals 45.

While the invention has been described in its preferred embodiments, it is to understood that the words that have been used are words of description rather than limitation and that changes may be made within the purview of the appended claims without departing from the true scope and spirit of the invention in its broader aspects.

We claim:

1. An antenna of the type having coaxial transmission line elements coupled in a manner which connects the inner conductor of a coaxial transmission line element to the outer conductor of an adjacent coaxial transmission element comprising:

an electrical conducting integral structure having first and second circular sections and a web;

said second circular section having an inner surface with an inner diameter and positioned such that said inner surface serves as an outer conductor for one coaxial transmission line element of said antenna, said first circular section being electrically connected to an inner conductor of a coaxial transmission line element adjacent to said one coaxial transmission line element, thereby electrically connecting said outer conductor of said one coaxial transmission line element to said inner conductor of said adjacent coaxial transmission line element.

2. An antenna in accordance with claim 1 wherein said first circular section is electrically connected to said inner conductor of said coaxial transmission element adjacent to said one coaxial transmission line element by crimping.

3. An antenna in accordance with claim 1 wherein said first circular section is electrically connected to said inner conductor of said coaxial transmission element adjacent to said one coaxial transmission line element by soldering.

4. An antenna in accordance with claim 1 further including electrical coupling terminals positioned on an outer surface of said second circular section.

5. An integral structure in accordance with claim 1 wherein said second section has a length which is equal to one-half wavelength of a wave at a design frequency of said array of coaxial transmission elements.

6. An integral structure in accordance with claim 1 wherein said first and second circular sections have equal lengths.

* * * * *